United States Patent [19]

Deeg et al.

[11] Patent Number: 4,693,176

[45] Date of Patent: Sep. 15, 1987

[54] AIR OUTLET FOR ROOM CONDITIONING SYSTEMS

[75] Inventors: Helmut Deeg, Sulz-Attikon; Christian Imhof, Oerlingen, both of Switzerland

[73] Assignee: Sulzer Brothers Limited, Winterthur, Switzerland

[21] Appl. No.: 839,366

[22] Filed: Mar. 13, 1986

Related U.S. Application Data

[63] Continuation of Ser. No. 691,633, Jan. 15, 1985, abandoned.

[30] Foreign Application Priority Data

Jan. 23, 1984 [CH] Switzerland ..... 277/84

[51] Int. Cl.[4] ..... F24F 13/075

[52] U.S. Cl. ..... 98/40.12

[58] Field of Search ..... 98/40.01, 40.02, 40.05, 98/40.1, 40.11, 40.12, 40.13, 40.2, 40.23, 40.27

[56] References Cited

U.S. PATENT DOCUMENTS

| | | | |
|---|---|---|---|
| 2,135,810 | 11/1938 | Germonprez | 98/40.01 |
| 2,607,282 | 8/1952 | Gilbert | 98/40.23 |
| 2,655,857 | 10/1953 | Broberg | 98/40.2 |
| 2,670,566 | 3/1954 | Tuft | 98/40.01 X |
| 3,092,009 | 6/1963 | Guettl | 98/40.12 |
| 3,122,087 | 2/1964 | Demuth et al. | 98/40.12 |
| 3,319,558 | 5/1967 | Bodian | 98/40.01 |
| 3,358,577 | 12/1957 | Thomson | 98/40.01 |
| 3,363,535 | 1/1968 | Sweeney | 98/40.12 |
| 3,559,560 | 2/1971 | Trahan | 98/40.12 |
| 3,623,419 | 11/1971 | Taylor . | |
| 3,736,858 | 6/1973 | Mercier | 98/40.02 |
| 3,898,921 | 8/1975 | Trube et al. | 98/40.02 |
| 3,913,468 | 10/1975 | Krämer et al. | 98/40.05 |
| 4,616,558 | 10/1986 | Ball et al. | 98/40.11 |

FOREIGN PATENT DOCUMENTS

| | | | |
|---|---|---|---|
| 2286352 | 4/1976 | France | 98/40.02 |
| 301735 | 9/1954 | Switzerland . | |
| 533139 | 2/1941 | United Kingdom | 98/40.27 |

*Primary Examiner*—Harold Joyce

*Attorney, Agent, or Firm*—Kenyon & Kenyon

[57] ABSTRACT

The slats which are disposed at the bottom of the air outlet are rotatably mounted and have vanes which define an angle therebetween of other than 180°. The slats can be adjusted to a desired angular position and fixed by threaded screw connections. The adjustment of the slats permits the direction of the discrete air streams issuing from the outlet to be controlled.

5 Claims, 2 Drawing Figures

AIR OUTLET FOR ROOM CONDITIONING SYSTEMS

Figure 1:
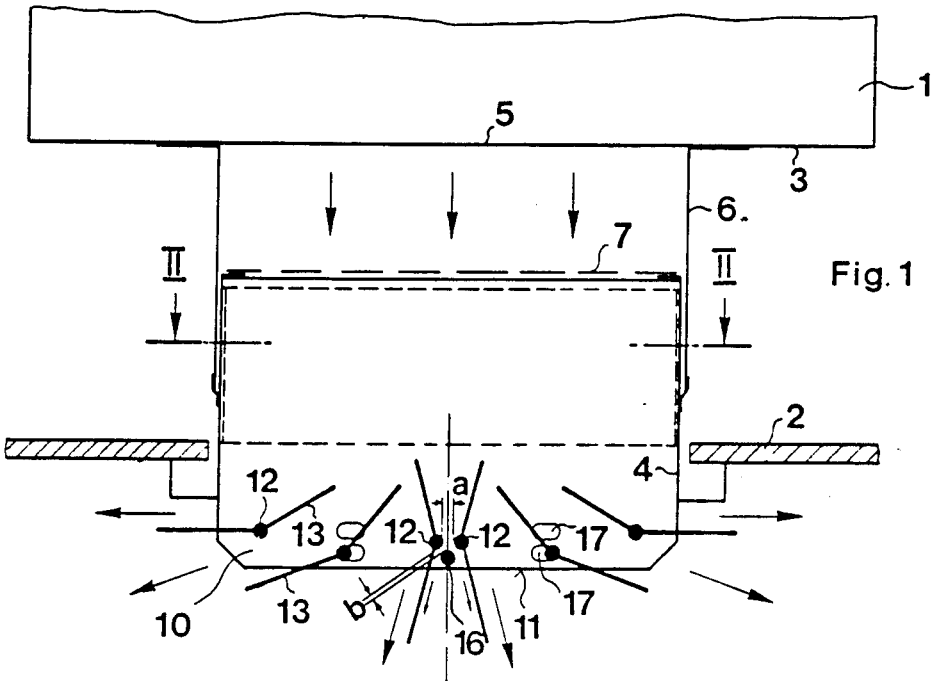

This is a continuation of appication Ser. No. 691,633 filed Jan. 15, 1985, now abandoned.

This invention relates to an air outlet for room conditioning systems. More particularly, this invention relates to a rectangular air outlet for an air intake duct for a room conditioning system.

As is known, room conditioning systems frequently employ an air intake duct which extends along the ceiling region of a room and which has one or more air outlets for discharging air into the room. Generally, the air outlet has been constructed of rectangular shape and has employed deflectors which extend perpendicularly to the lateral boundaries of the outlet in order to distribute the air flow into the room. As described in Swiss Pat. No. 301,735, one known air outlet is constructed so as to be connected to an air intake duct which is supplied with an intake air flow with the long sides of the outlet parallel to the air duct. As considered in the flow direction of the issuing air, the air outlet has a plurality of transverse deflectors followed by deflectors which are parallel to the long sides of the outlet. The main function of the transverse deflectors or "rectifiers" is to achieve a considerable degree of uniformity in the air distribution over the length of the air outlet and to prevent a back-up of air at the downstream end of the outlet. This is accomplished by the deflectors retarding the velocity component of the air in the direction of the air intake duct.

The following deflectors which extend lengthwise of the outlet duct are responsible for distribution transversely of the air outlet and air intake duct. These deflectors have therefore been conventionally devised as fixed or adjustable vanes whose exit edges are at least substantially at ceiling level.

It has been found that the transverse distribution provided by the known air outlets is unsatisfactory and that it is almost impossible to control the direction and range particularly of the outer streams which, when a ceiling is present, often extend along the ceiling because of the Coanda effect.

Accordingly, it is an objection of the invention to improve the transverse distribution more particularly of large quantities of air in direction and range within an air flow from a room conditioning system.

It is another object of the invention to be able to readily change the amount and direction of air flow from an air outlet of a room conditioning system.

It is another object of the invention to provide a relatively simple construction for a rectangular air outlet which is capable of efficiently distributing an air flow therefrom.

Briefly, the invention provides an air outlet for an air intake duct of a room conditioning system which includes a plurality of vertically disposed deflectors for distributing a flow of air within the outlet and a plurality of slats which are disposed below the deflectors with each slat including a rotatably mounted spindle and a pair of vanes which extend from the spindle to define an angle therebetween of other than 180°.

The construction of the air outlet is such that the vertically disposed deflectors extend downwardly to an exit plane in order to define a plurality of longitudinally disposed chambers for distributing an air flow therebetween. The slats are disposed below the exit plane in perpendicular relation to the deflectors for transversely distributing the air from the outlet.

In cases where there is a double ceiling, the exit plane is usually the ceiling plane while in cases where there is no double ceiling, the exit plane corresponds to the plane containing the base of an air intake duct, whereby the air outlet is mounted, inside of the air intake duct partly so that the deflectors are positioned before said exit plane.

The two-vaned construction of the slats and the angular positioning makes it possible, for example, to have uniform distribution over the while room over the air issuing from the air outlet. Usually, the outer streams flow along the ceiling because of the Coanda effect in the case of a double ceiling; however, the outer streams can, in such systems, be detached from the ceiling by a correspondingly "steep" setting of the outer slats so that all the intake air, spread out in a fairly wide fan, flows substantially into a relatively narrow zone of the room.

For air distribution which is uniform and symmetrical of an air-outlet central plane parallel to the air intake duct, outer, inner and central slats are provided and are disposed and adjusted in laterally inverted relationship to the central plane parallel to their pivotal spindles. The slats extend outwardly from the central plane to both sides with the minor angle of the vanes facing outwardly. Of course, asymmetrical air distributions can be arranged, for instance, for air outlets close to a wall.

In known air outlets in which the air streams spread out to both sides over the whole room, it is often difficult to stabilize the central air stream since this stream can easily undergo an uncontrolled deflection to one side and, depending upon local and instantaneous flow states, change its deflection from one side to the other. The stability of the central stream can be improved considerably if a baffle is disposed between the slats which are near the central plane downstream of the narrowest cross-section of a passage defined between the slats with the sum of the minimal cross-sections which remain between the baffle and the slats being less than the narrowest cross-section between the two slats.

Advantageously, in order to be able to vary the width and intensity of the air streams in the central zone —i.e., the air streams in a relatively narrow opening angle vertically below the air outlet —the central slats between the outer slat sand the inner slats are movable parallel to the exit plane. Moving these central slats to various level planes relative to the exit plane can vary the opening width more particularly of the substantially horizontal outer streams.

It is advantageous for flow guidance and for production if the slat vanes are of unequal width with the upstream vane of each slat being shorter in the air flow direction.

Figure 2:
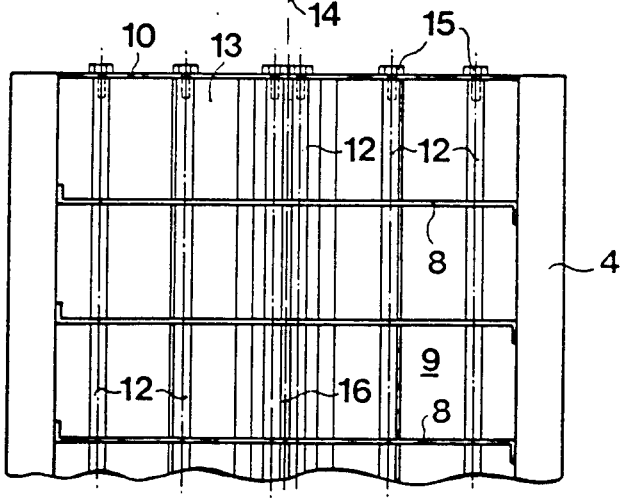

These and other objects and advantages of the invention will become more apparent from the following detailed description taken in conjunction with the accompanying drawings wherein:

FIG. 1 illustrates a diagramatic sectional view taken perpendicularly of an air intake duct and an air outlet constructed in accordance with the invention; and FIG. 2 illustrates a view taken on line II—II of FIG. 1.

Referring to FIG. 1, an air intake duct 1 which extends perpendicularly to the plane of the drawing is disposed above an exit plane or ceiling 2. This duct 1 has an aperture 5 in its base which is adapted to the size of a rectangular air outlet 4. In addition, an outlet connector 6 is fitted to the duct 1 so as to connect the air outlet 4 to the duct 1. The function of the connector 6 has to do with industrial prefabrication of the air outlet 4 and is compensate for different distances between the ceiling 2 and the duct 1, the outlet 4 being slid by varying amounts into the connector 6.

Referring to FIGS. 1 and 2, the air outlet 4 includes a rectangular box-like sheet metal casing which is covered at the top end by a perforate plate 7 in order to receive an air flow from the intake duct 1. In addition, a plurality of fixed parallel deflectors 8 are disposed within the casing in order to define a plurality of longitudinally disposed consecutive chambers 9 for distributing an air flow therebetween. As indicated in FIG. 2, the deflectors 8 extend parallel to the narrow sides of the casing of the outlet 4. In addition, as indicated in FIG. 1, the deflectors 8 extend to the plane of the ceiling 2. These deflectors 8 function to destroy the velocity component of the air in the direction of the flow in the intake duct 1 and ensure uniform air distribution over the length of the air outlet 4.

As indicated in FIG. 1, the long sides of the casing are bent outwardly over two right-angle bends so as to contact the ceiling 2 and thus cover a gap remaining between the ceiling 2 and the outlet 4. The narrow casing sides of the air outlet 4 project beyond the ceiling 2 some distance into the room.

Referring to FIG. 1, a plurality of slats are disposed below the fixed deflectors 8 and, thus, below the exit plane defined by the ceiling 2. The slats are mounted in the narrow sides 10 of the casing near the bottom edge and are distributed over the width of the outlet 4. Each slat includes a spindle 12 and a pair of vanes 13 which extend from the spindle 12. As indicated in FIGS. 1 and 2, the spindles 12 are rotatably mounted at each end in the depending narrow sides 10 of the casing of the air outlet 4 and are fixedly secured by a screwed connection 15 so as to be located in a required angular position. The slats 13 of each vane are disposed relative to each other to define an obtuse angle of other than 180° ($\pi$). The angular setting of each vane can be adjusted via the spindles 12.

The slats are disposed in laterally inverted relationship about a central longitudinal plane 14 of the air outlet 4 in parallel to the spindles 12 with the minor vane angle of each slat directed outwardly. In addition, the individual slats are disposed in planes which are at different distances from the ceiling 2.

For manufacturing reasons, all the slats are of identical dimensions. However, the vanes 13 of the slat are of unequal width with the upstream or inner vane of each slat being shorter than the downstream or outer vane 13 in the air flow direction. Material is thus saved in the case of aluminum slats and less vertical space is required inside the air outlet 4.

Referring to FIG. 1, a baffle 16 in the form of a round rod is disposed in the central plane 14 below the inner slats. In addition, the baffle 16 is disposed downstream of the narrowest cross-section of the passage defined between the slats adjacent the baffle and is spaced from each of these adjacent slats a clear distance less than one-half the width of the narrowest cross-section. As illustrated, the narrowest horizontal cross-section a through which the central stream of air flows is greater in width than the sum of the two distances b between the rod 16 and each adjacent spindle 12. The flow of the central stream is therefore accelerated near rod 16 with a consequent improvement in stability so that a stable vertical stream symmetric to the central plane 14 is ensured.

As indicated in FIG. 1, the narrow casing sides 10 are formed with slots 17 for mounting of the central slats of each symmetric half of the air outlet 14 to permit the central slats to be moved horizontally. This permits those components of the central air stream which flow along the outsides of the central slats to be varied in width and, therefore, in intensity. Further, a pair of slots 17 are vertically disposed one above the other at different levels in relation to the planes of the other slots to permit a vertical adjustment of the central slats. The central adjustment of the central slats permit the opening of the laterally spread-out substantially horizontal streams to be varied so that the range of these streams can be adapted to the lateral dimensions of the rooms and/or two differences in the available volumes of air.

The construction of the air outlet 4 is such that the central slats on each side of the central plane 14 are movable parallel to and perpendicularly to the exit plane defined by the ceiling 2.

The invention thus provides an air outlet which can be readily adapted to improve the transverse distribution of large quantities of air, for example, quantities of more than 1500 cubic meters per hour in direction and range.

Further, the invention provides an air outlet wherein the flow distribution of air over an entire room can be improved due to the shape and arrangement of the slats while stabilizing the position of the discrete air streams issuing from the air outlet.

Furthermore, the invention provides a means of permitting individual adaptation of the angular position of the vanes at the exit end of the outlet to the particular room concerned.

What is claimed is:

1. A rectangular air outlet for an air intake duct of a room conditioning system, said outlet having a plurality of vertically disposed deflectors extending downwardly to a common horizontal plane for distributing a flow of air;

a plurality of slats disposed below said horizontal plane in laterally inverted relationship about a central vertical plane, each said slat including a rotatably mounted spindle and a pair of vanes extending from said spindle to define an obtuse angle therebetween, at least one of said slats being rotatable to position a vane thereof in parallel to said horizontal plane for directing a stream of air horizontally outwardly; and a baffle in said central plane downstream of a passage defined between said spindles of the slats adjacent said baffle and spaced from each adjacent spindle a clear distance of less than one-half the width of said passage.

2. A rectangular air outlet as set forth in claim 1 wherein said spindles of said slats are disposed in different planes parallel to said horizontal plane.

3. A rectangular air outlet as set for in claim 1 which further comprises a pair of sides having horizontally elongated slope receiving at least the central slats on each side of said central plane for movement parallel to and perpendicular to said horizontal plane.

4. A rectangular air outlet as set forth in claim 1 wherein said slats are directed outwardly of said central plane with the minor vane angle facing outwardly.

5. A rectangular air outlet as set forth in claim 1 wherein said vanes of each slat are of unequal width with the upstream vane of each slat being shorter in the air flow direction.

* * * * *

UNITED STATES PATENT AND TRADEMARK OFFICE

CERTIFICATE OF CORRECTION

PATENT NO. : 4,693,176

DATED : Sept. 15 1987

INVENTOR(S) : Helmut Deeg

It is certified that error appears in the above-identified patent and that said Letters Patent is hereby corrected as shown below:

Column 1, line 48 "flow from" should be -outlet of-
Column 2, line 7 "mounted, inside" should be -mounted inside-
Column 2, line 12 "while" should be -whole-
Column 2, line 47 "slat sand" should be -slats and-
Column 3, line 5 after "is" insert -to-
Column 4, line 56 "for" should be -forth-
Column 4, line 58 "slope" should be -slots- Signed and Sealed this Twenty-second Day of March, 1988

*Attest:*

DONALD J. QUIGG

*Attesting Officer*

*Commissioner of Patents and Trademarks*